US011286603B2

(12) United States Patent
Lee et al.

(10) Patent No.: US 11,286,603 B2
(45) Date of Patent: Mar. 29, 2022

(54) LAUNDRY TREATING APPARATUS AND CONTROLLING METHOD THEREOF

(71) Applicant: LG Electronics Inc., Seoul (KR)

(72) Inventors: Kiwook Lee, Seoul (KR); Jungmoon Je, Seoul (KR)

(73) Assignee: LG Electronics Inc., Seoul (KR)

( * ) Notice: Subject to any disclaimer, the term of this patent is extended or adjusted under 35 U.S.C. 154(b) by 490 days.

(21) Appl. No.: 16/177,859

(22) Filed: Nov. 1, 2018

(65) Prior Publication Data

US 2019/0127900 A1 May 2, 2019

(30) Foreign Application Priority Data

Nov. 1, 2017 (KR) ..... 10-2017-0144866

(51) Int. Cl.

| | |
|---|---|
| ***D06F 33/47*** | (2020.01) |
| ***D06F 33/00*** | (2020.01) |
| *D06F 39/08* | (2006.01) |
| *D06F 103/18* | (2020.01) |
| *D06F 103/38* | (2020.01) |
| *D06F 103/42* | (2020.01) |
| *D06F 103/48* | (2020.01) |
| *D06F 103/70* | (2020.01) |
| *D06F 105/08* | (2020.01) |

(Continued)

(52) U.S. Cl.

CPC ..... *D06F 33/47* (2020.02); *D06F 33/00* (2013.01); *D06F 34/08* (2020.02); *D06F 34/28* (2020.02); *D06F 39/085* (2013.01); *D06F 2101/20* (2020.02); *D06F 2103/18* (2020.02); *D06F 2103/38* (2020.02); *D06F 2103/42* (2020.02); *D06F 2103/48* (2020.02); *D06F 2103/70* (2020.02); *D06F 2105/08* (2020.02); *D06F 2105/48* (2020.02); *D06F 2105/54* (2020.02); *D06F 2105/58* (2020.02)

(58) Field of Classification Search

CPC ..... D06F 33/00; D06F 39/082; D06F 39/085; D06F 34/28

See application file for complete search history.

(56) References Cited

U.S. PATENT DOCUMENTS 6,663,349 B1 * 12/2003 Discenzo ..... F04D 15/0245 417/300
2005/0127865 A1 * 6/2005 Kiuchi ..... H02P 6/21 318/802

FOREIGN PATENT DOCUMENTS

CN 102031666 A * 4/2011
CN 104639008 5/2015

(Continued)

OTHER PUBLICATIONS

Machine translation of CN-102031666-A, dated Apr. 2011. (Year: 2011).*

(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

The present invention provides a laundry treating apparatus including a drain pump having a motor, an inverter unit to transfer power to the motor, and a control unit to control the inverter unit to operate the drain pump, wherein the control unit sets an operation mode of the drain pump based on a current flowing in a part of the inverter unit, and controls the inverter unit based on the set operation mode.

20 Claims, 13 Drawing Sheets

(51) Int. Cl.

| | |
|---|---|
| *D06F 105/48* | (2020.01) |
| *D06F 105/54* | (2020.01) |
| *D06F 105/58* | (2020.01) |
| *D06F 34/08* | (2020.01) |
| *D06F 101/20* | (2020.01) |
| *D06F 34/28* | (2020.01) |

(56) References Cited

FOREIGN PATENT DOCUMENTS

| | | |
|---|---|---|
| CN | 104980067 | 10/2015 |
| JP | 2000102700 | 4/2000 |
| KR | 100175234 | 5/1999 |
| KR | 100746073 | 8/2007 |
| KR | 1020080089840 | 10/2008 |
| KR | 1020110112486 | 10/2011 |
| KR | 101165628 | 7/2012 |
| KR | 101756408 | 7/2017 |

OTHER PUBLICATIONS

Office Action in Chinese Appln. No. 201880071315.1, dated Dec. 3, 2021, 13 pages (with English translation).

* cited by examiner

LAUNDRY TREATING APPARATUS AND CONTROLLING METHOD THEREOF

CROSS-REFERENCE TO RELATED APPLICATION

Pursuant to 35 U.S.C. § 119(a), this application claims the benefit of an earlier filing date of and the right of priority to Korean Application No. 10-2017-0144866, filed on Nov. 1, 2017, the contents of which are incorporated by reference herein in its entirety.

BACKGROUND OF THE DISCLOSURE

1. Field of the Disclosure

The present invention relates to a laundry treating apparatus that washes, dries or dehydrates the laundry, and a control method for the same.

2. Background of the Disclosure

Laundry treating apparatuses may be classified into a top-loading type and a front-loading type depending on a laundry input method.

The top-loading type laundry treating apparatus includes a cabinet forming an outer appearance, a tub disposed inside the cabinet to provide a space for accommodating laundry or clothes, and an introduction port provided on an upper surface of the cabinet to communicate with the tub.

The front-loading type laundry treating apparatus includes a cabinet forming an outer appearance, a tub disposed inside the cabinet to provide a space for accommodating laundry, and an introduction port provided on a front surface of the cabinet to communicate with the tub.

On the other hand, a drain (circulation) pump is used to drain remaining water in a washing tub (or a tub) of a laundry treating apparatus and to circulate washing water when a washing stroke is performed, and various methods for stable operation of the drain pump are being discussed.

Generally, an AC motor is mounted on the drain pump, and constant speed driving is performed by a frequency command value applied from a control unit of the laundry treating apparatus.

According to the drain pump having the AC motor, even when a flow path formed in the drain pump or a hose connected to the drain pump is clogged with foreign substances accumulated in the drain pump by a predetermined amount or more, the drain pump continues to rotate at a constant speed. This causes a problem that the clogged state of the drain pump cannot be detected.

Further, if the operation of the drain pump is continued without detecting the clogging of the drain pump, it may cause a failure of the drain pump and its related components, thus inconveniencing a user.

On the other hand, Korean Registration Patent Application No. 10-0746073 (published on Aug. 6, 2007), which is a technique related to detecting clogging of a drain pump or a flow path, discloses a method of controlling an operation of a feedwater valve that repetitively turns on and off the feedwater valve several times when a water level of washing water continuously increases even during a washing stroke.

However, in Korean Registration Patent Application No. 10-0746073, clogging is not accurately detected because the clogging is indirectly judged based on an increase of a water level. In addition, by turning on and off a valve from time to time, control efficiency is also lowered. That is, in Korean Registration Patent Application No. 10-0746073, the clogging is not detected by using a driving state of a motor. As a result, even when other factors causing the increase of the water level occur, the clogging may be detected erroneously.

In addition, Korean Registration Patent Application No. 10-1165628 (published on Jul. 17, 2012) discloses a drain bellows pipe to prevent clogging in drainage.

However, Korean Registration Patent Application No. 10-1165628 merely discloses that the drain bellows pipe has a physical shape capable of preventing the clogging, but fails to teach or suggest a washing machine control method for determining whether or not the bellows pipe is clogged.

Recently, by introducing a BLDC motor into the drain pump, it is possible to variably control revolutions per minute (RPM) (or a rotation speed) of the motor and electric power consumed by the motor.

Accordingly, there is a need for a control method for a laundry treating apparatus capable of detecting clogging of a drain pump by using characteristics of a BLDC motor.

SUMMARY OF THE DISCLOSURE

An aspect of the present invention is to provide a drain pump driving apparatus capable of facilitating a drainage and a laundry treating apparatus having the same.

Another aspect of the present invention is to provide a drain pump driving apparatus capable of judging whether or not the drain pump is clogged without an additional sensor, and a laundry treating apparatus having the same.

Still another aspect of the present invention is to provide a drain pump driving apparatus capable of eliminating clogging of the drain pump when the clogging occurs, and a laundry treating apparatus having the same.

Still another aspect of the present invention is to provide a laundry treating apparatus capable of providing information related to clogging of a drain pump to a user when the clogging occurs.

A laundry treating apparatus according to an embodiment of the present invention to achieve the aspects and other advantages may include a drain pump having a motor, an inverter unit to transfer power to the motor, and a control unit to control the inverter unit to operate the drain pump, wherein the control unit sets an operation mode of the drain pump based on a current flowing in a part of the inverter unit, and controls the inverter unit based on the set operation mode.

In one embodiment, the inverter unit may include a plurality of switches, a direct current (DC)-link capacitor, and a shunt resistor disposed between the DC-link capacitor and the switches.

In one embodiment, the control unit may detect a DC-link current flowing in the DC-link capacitor using the shunt resistor, and set the operation mode of the drain pump based on the detected DC-link current.

In one embodiment, the control unit may set the operation mode of the drain pump to a first operation mode when a magnitude of the detected DC-link current is decreased to a preset reference current value or less.

In one embodiment, the control unit may re-compare the magnitude of the DC-link current with the reference current value when the first operation mode is terminated.

In one embodiment, the control unit may set the operation mode of the drain pump to a second operation mode when the magnitude of the DC-link current is increased to the reference current value or more after the first operation mode is terminated.

In one embodiment, the control unit may control the inverter unit to turn off all the switches included in the inverter unit for a predetermined time interval before re-comparing the magnitude of the DC-link current with the reference current value after the termination of the first operation mode.

In one embodiment, the control unit may determine that a flow path formed in the drain pump has been clogged when the magnitude of the detected DC-link current is decreased to the predetermined reference current value or less.

In one embodiment, the control unit may determine that the flow path formed in the drain pump has been clogged when the detected DC-link current is maintained at the reference current value or less for more than a predetermined time interval.

In one embodiment, the laundry treating apparatus may further include an output unit to output information related to the operation of the laundry treating apparatus, and the control unit may control the output unit to output alarm information when it is determined that the flow path formed in the drain pump has been clogged.

In one embodiment, the inverter unit may further include a current sensor to detect a phase current flowing in at least one of the plurality of switches, and the control unit may detect a magnitude of the phase current using the current sensor.

In one embodiment, the control unit may set the operation mode of the drain pump based on the magnitude of the phase current.

In one embodiment, the laundry treating apparatus may further include a tub to accommodate laundry and washing water therein, and a water level sensor to detect information related to a water level of the washing water accommodated in the tub, and the control unit may set the operation mode of the drain pump using the water level sensor.

In one embodiment, the control unit may determine that the flow path formed in the drain pump has been clogged when a frequency of the water level sensor is a preset reference frequency value or less and the detected DC-link current is lowered to the reference current value or less.

A laundry treating apparatus according to the present invention can determine whether a flow path in a drain pump or a flow path connected to the drain pump has been clogged even without additionally using a separate sensor, thereby enhancing user convenience.

Also, the laundry treating apparatus according to the present invention can control a BLDC motor based on a power command value corresponding to a predetermined power value when it is determined that clogging of the drain pump has occurred, thereby eliminating the clogging of the drain pump. This may result in obtains an effect of ensuring performance of the drain pump.

Therefore, according to a control method for the laundry treating apparatus of the present invention, a lifespan of the drain pump or the flow path connected to the drain pump can increase and a failure of the laundry treating apparatus can be prevented.

Further, the laundry treating apparatus according to the present invention can notify the user of the clogging of the drain pump, thereby inducing the user to recognize the failure of the drain pump.

DETAILED DESCRIPTION OF THE DISCLOSURE

Hereinafter, the present invention will be described in detail with reference to the drawings.

Figure 1A:
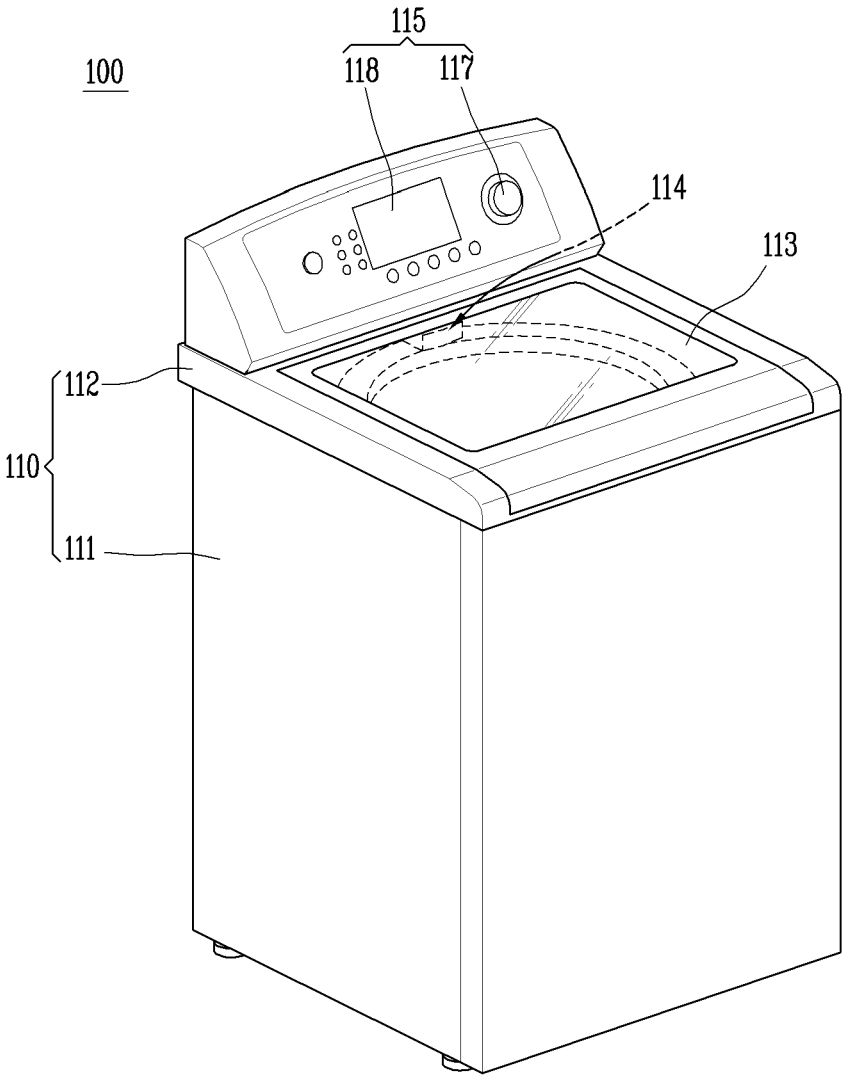
FIG. 1A is a perspective view of a laundry treating apparatus in accordance with one embodiment of the present invention.
Figure 1B:
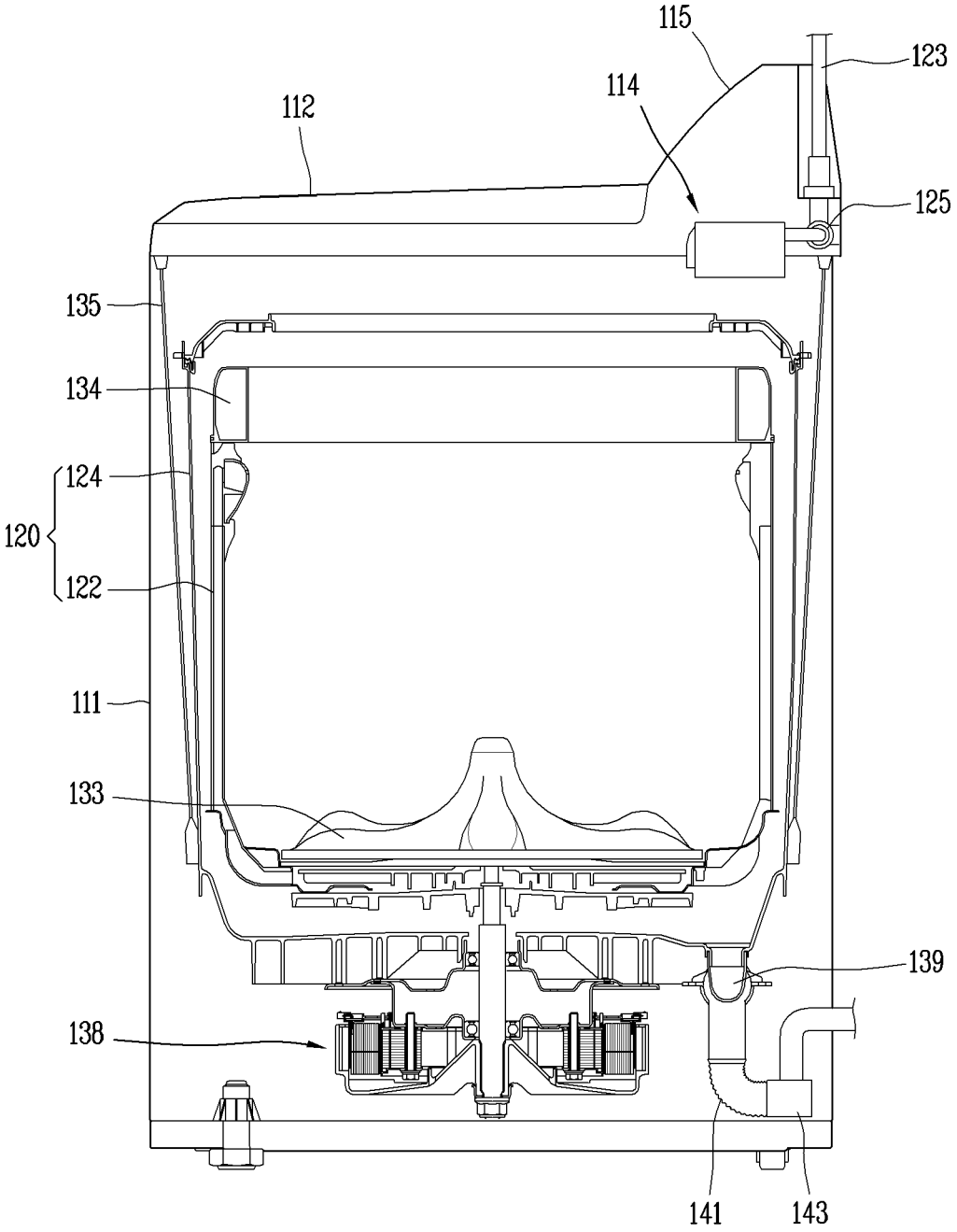
FIG. 1B is a side sectional view of the laundry treating apparatus of FIG. 1A.

FIG. 1A is a perspective view of a laundry treating apparatus in accordance with one embodiment of the present invention, and FIG. 1B is a side sectional view of the laundry treating apparatus of FIG. 1A. For reference, the laundry treating apparatus illustrated in FIGS. 1A and 1B is defined as a top-loading type.

As illustrated in FIGS. 1A and 1B, a laundry treating apparatus 100 according to one embodiment of the present invention is a concept including a washing machine which performs washing, rinsing, dewatering and the like of clothes or laundry introduced therein, or a dryer which performs drying wet clothes introduced therein. Hereinafter, description will be given mainly of a washing machine.

Referring to FIGS. 1A and 1B, description will be given exemplarily of a top-loading type washing machine. However, the technical idea of the present invention is not limited to the top-loading type washing machine, but may be applied to any kind of laundry treating apparatus if it is provided with a drain pump having a BLDC motor.

The washing machine 100 includes a casing 110 forming an outer appearance, a control panel 115 provided with operation keys for receiving various control commands from a user, and a display for displaying information related to an operation state of the washing machine 100, and a door rotatably installed at the casing 110 to open and close an inlet/outlet hole through which the laundry is taken in and out.

The casing 110 includes a main body 111 forming a space in which various components of the washing machine 100 can be accommodated, and a top cover 112 provided on a top of the main body 111 and having a clothes inlet/outlet hole through which the clothes can be taken in and out.

The casing 110 is described as including the main body 111 and the top cover 112 but it is not limited to this. It is sufficient if the casing 110 forms the appearance of the washing machine 100.

Support rods 135 are described as being coupled to the top cover 112 which is one of the constituent elements of the casing 110. The support rods 135 are not limited to the structure but may be coupled to any of fixed portions of the casing 110.

The control panel 115 includes operation keys 117 for activating operation states of the laundry treating apparatus 100, and a display 118 disposed at one side of the operation keys 117 for displaying the operation states of the laundry treating apparatus 100.

The door 113 opens and closes a clothes inlet/outlet hole (not shown) formed at the top cover 112, and may include a transparent member made of tempered glass so that an inside of the main body 111 can be seen.

The washing machine 100 may include a washing tub 120. The washing tub 120 may include an outer tub 124 containing washing water and an inner tub 122 rotatably installed in the outer tub 124 to receive the laundry. A balancer 134 may be provided on a top of the washing tub 120 to compensate for eccentricity generated when the washing tub 120 rotates.

Meanwhile, the washing machine 100 may include a pulsator 133 rotatably provided at a lower portion in the washing tub 120.

A driving apparatus 138 is to supply a driving force for rotating the inner tub 122 and/or the pulsator 133. A clutch (not shown) for selectively transmitting the driving force of the driving apparatus 138 may be provided so that only the inner tub 122 or only the pulsator 133 rotates or both the inner tub 122 and the pulsator 133 rotates simultaneously.

Figure 3:
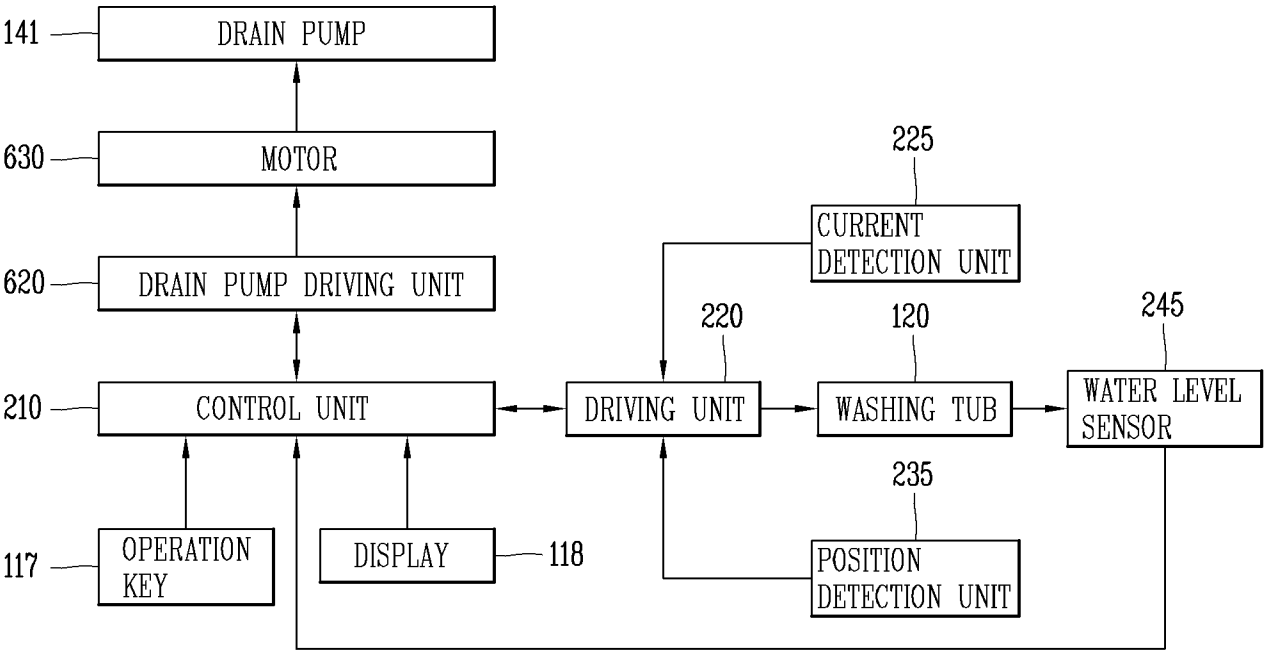
FIG. 3 is an internal block diagram of the laundry treating apparatus of FIG. 1A or FIG. 2.

On the other hand, the driving apparatus 138 is operated by a driving unit 220 of FIG. 3, that is, a driving circuit. This will be described later with reference to FIG. 3.

Meanwhile, the top cover 112 is provided with a detergent box 114 disposed therein to be drawn in and out to store various detergents, such as laundry detergent, fabric softener and/or bleach. Washing water fed through a feedwater flow path 123 is supplied into the inner tub 122 via the detergent box 114.

A plurality of holes (not shown) are formed through the inner tub 122 so that the washing water supplied to the inner tub 122 flows to the outer tub 124 through the plurality of holes. A feedwater valve 125 for opening and closing the feedwater flow path 123 may be provided.

The washing water inside the outer tub 124 is drained through a drain flow path 141. A drain valve 143 for opening and closing the drain flow path 141 and a drain pump 139 for pumping washing water may be provided.

The support rods 135 are to suspend the outer tub 124 in the casing 110. Each support rod 135 has one end connected to the casing 110 and another end connected to the outer tub 124 by a suspension 150.

The suspension 150 buffers vibration of the outer tub 124 during the operation of the washing machine 100. For example, the outer tub 124 may vibrate due to vibration generated as the inner tub 122 rotates. It may be possible to buffer the vibration of the outer tub 124 which is caused by various factors such as an eccentric state of the laundry contained in the inner tub 122, a rotation speed of the inner tub 122, resonance characteristics, and the like.

Hereinafter, another embodiment of a laundry treating apparatus will be described with reference to FIG. 2. For reference, the laundry treating apparatus shown in FIG. 2 is defined as a front-loading type.

Figure 2:
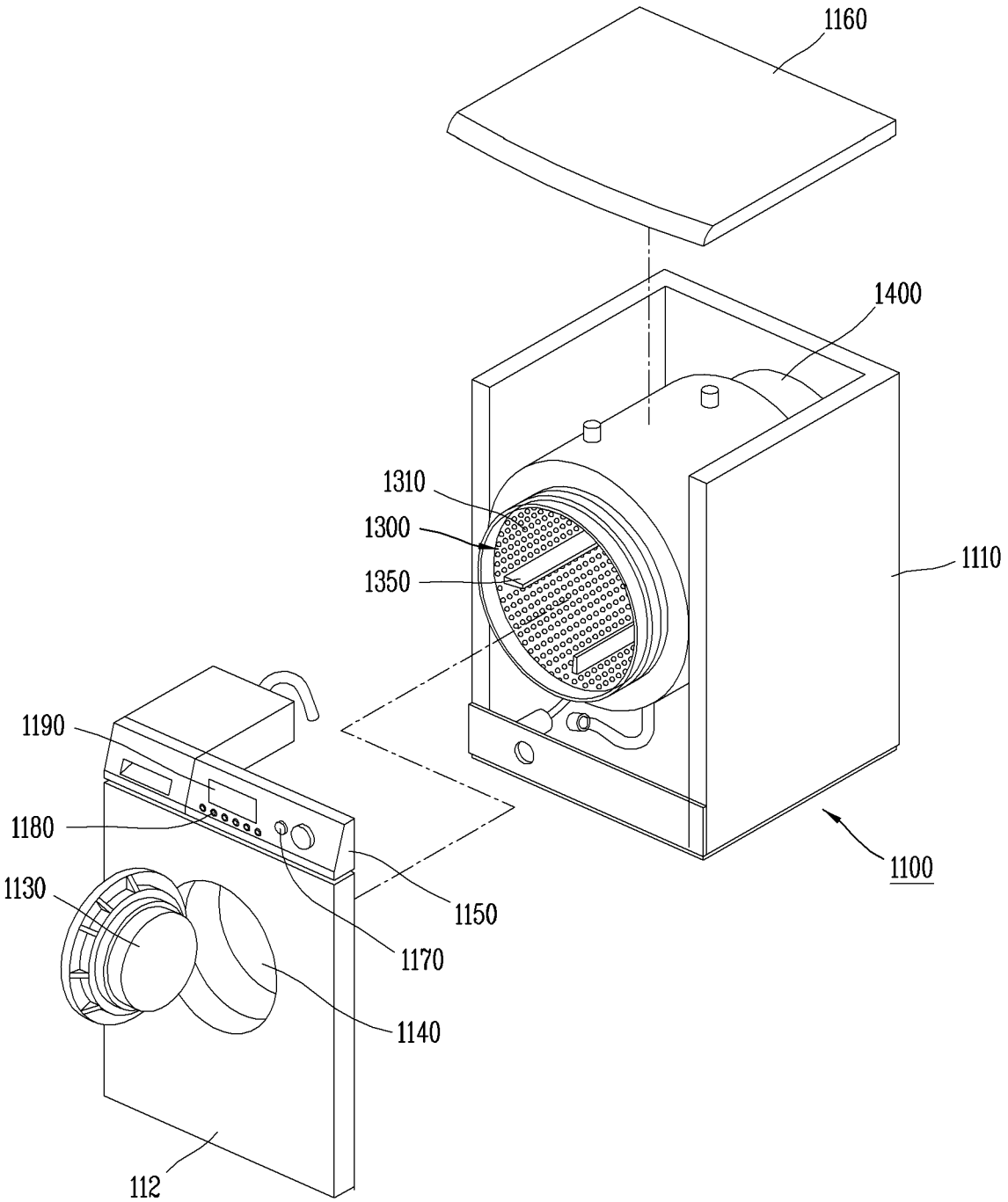
FIG. 2 is a perspective view of a laundry treating apparatus in accordance with another embodiment of the present invention.

Referring to FIG. 2, a laundry treating apparatus according to another embodiment includes a cabinet 1100 forming an outer appearance, a tub 1200 provided in the cabinet and supported by the cabinet, a drum 1300 rotatably provided in the tub to accommodate the laundry, a motor to rotate the drum by applying torque to the drum, and a control panel 1150 to allow a user to select an operation mode of the laundry treating apparatus or apply an input related to an execution of the selected operation mode.

The cabinet 1100 includes a main body 1110, a cover 1120 coupled to a front surface of the main body, and a top plate 1160 coupled to a top of the main body. The cover 1120 may include an opening 1140 through which the laundry is introduced or taken out, and a door 1130 to selectively open and close the opening.

The drum 1300 forms a space in which the introduced laundry is washed. The drum 1300 is rotated by receiving power from the motor. The drum 1300 may be provided with a plurality of through holes 1310, so that washing water stored in the tub 1200 can be introduced into the drum 1300 and washing water inside the drum can be discharged to the tub through the through holes 1310. Therefore, when the drum rotates, dirt is removed from the laundry introduced into the drum during friction with the washing water stored in the tub.

The control panel 1150 may receive a user input related to an operation of the laundry treating apparatus. The control panel 1150 may also include a display to output information related to an operation state of the laundry treating apparatus.

That is, the control panel 1150 can implement an interface with the user.

Specifically, the control panel 1150 includes an operation unit 1170, 1180 to allow the user to input a control command, and a display unit 1190 to display control information according to the control command. The control panel may include a control unit (not shown) to control an operation of the laundry treating apparatus including an operation of the motor according to the control command.

FIG. 3 is an internal block diagram of the laundry treating apparatus of FIG. 1A or FIG. 2.

Referring to FIG. 3, in the laundry treating apparatus 100, a driving unit 220 is controlled by a control operation of the control unit 210. The driving unit 220 drives a main motor (not shown). The washing tub 120 is rotated in response to the driving of the main motor.

Meanwhile, the laundry treating apparatus 100 may include a pump motor 630 to drive the drain pump 141, and a drain pump driving unit 620 to control the pump motor 630. The drain pump driving unit 620 may be controlled by the control unit 210.

For reference, in the following description, "pump motor 630" and "motor 630" are defined as the same component. That is, the motor 630 is configured to drive the drain pump and must be distinguished from a main motor for rotating the washing tub.

In this specification, the drain pump driving unit 620 may also be referred to as a drain pump driving apparatus 620.

The control unit 210 is operated by receiving an operation signal from an operation key 1017. Accordingly, washing, rinsing, and dewatering can be performed.

The control unit 210 controls the display 118 to display a wash course, a wash time, a dehydration time, a rinsing time, or a current operation state.

Meanwhile, the control unit 210 controls the driving unit 220 to operate the main motor. For example, the control unit 210 may control the driving unit 220 to rotate the main motor based on a current detection unit 225 for detecting an output current flowing in the main motor and a position detection unit 235 for detecting a position of the main motor. It is illustrated in the drawing that the detected current and the detected position signal are input to the driving unit 220. However, the present invention is not limited to this. Alternatively, the detected current and the detected position signal may be input to the control unit 210 or both the control unit 210 and the driving unit 220.

The driving unit 220 is for driving the main motor, and may include an inverter (not shown) and an inverter control unit (not shown). Further, the driving unit 220 may be a concept further including a converter to supply DC power input to the inverter (not shown), and the like.

For example, when the inverter control unit (not shown) outputs a pulse width modulation (PWM) type switching control signal (Sic in FIG. 4) to the inverter (not shown), the inverter (not shown) may perform a fast switching operation to supply AC power of a predetermined frequency to the main motor.

The control unit 210 may detect an amount of laundry based on a current io detected by the current detection unit 220 or a position signal H detected by the position detection unit 235. For example, while the washing tub 120 rotates, the amount of laundry may be detected based on the current value io of the main motor.

The control unit 210 may detect eccentricity of the washing tub 120, that is, unbalance (UB) of the washing tub 120. This eccentricity detection may be performed based on a ripple component of the current io detected by the current detection unit 225 or a rotation speed variation of the washing tub 120.

Figure 4:
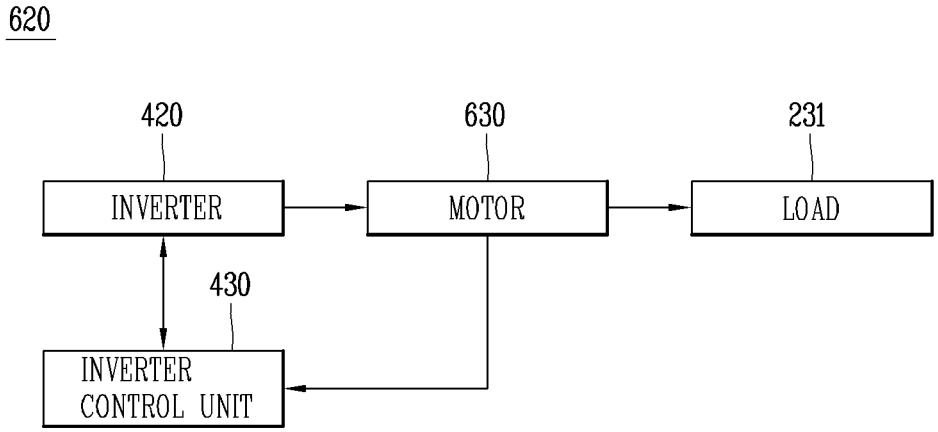
FIG. 4 is an internal block diagram illustrating an example of a drain pump driving apparatus of FIG. 1A or FIG. 2.
Figure 5:
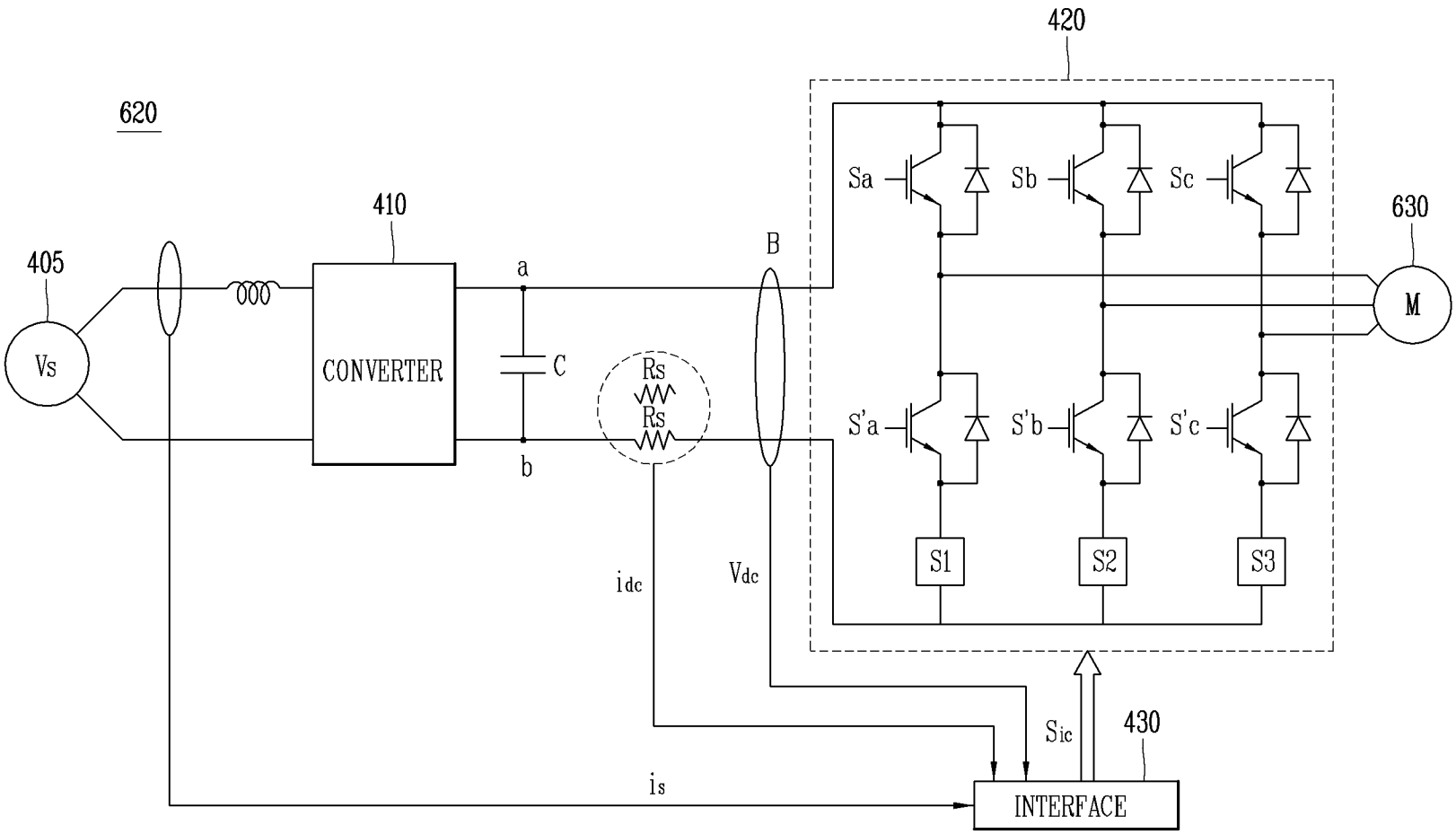
FIG. 5 is an internal circuit view illustrating an example of the drain pump driving apparatus of FIG. 4.

FIG. 4 is an internal block diagram illustrating an example of a drain pump driving apparatus of FIG. 1A or FIG. 2, and FIG. 5 is an internal circuit view illustrating an example of the drain pump driving apparatus of FIG. 4.

Referring to those drawings, the drain pump driving apparatus 620 according to the embodiment of the present invention is configured to drive the motor 630 in a sensorless manner and may include an inverter unit 420, an inverter control unit 430.

For reference, the inverter control unit 430 may have substantially the same configuration as the control unit 210 that controls the driving unit, or may correspond to a part of a circuit that configures the control unit 210.

The drain pump driving apparatus 620 according to the embodiment of the present invention may include a converter 410, a DC-link voltage detection unit B, a smoothing capacitor C, and an output current detection unit E. The drain pump driving apparatus 620 may further include an input current detection unit A, a reactor L, and the like.

Hereinafter, an operation of each constituent unit in the drain pump driving apparatus 620 of FIGS. 4 and 5 will be described.

The reactor L is disposed between a commercial AC power source 405, vs and the converter 410 to perform a power factor correcting or boosting operation. The reactor L may also perform a function of limiting a harmonic current due to fast switching of the converter 410.

The input current detection unit A may detect an input current applied from the commercial AC power source 405. To this end, a current transformer (CT), a shunt resistor, or the like may be used as the input current detection unit A. The detected input current may be input to the inverter control unit 430 as a pulse type discrete signal.

The converter 410 converts the commercial AC power source 405, which has passed through the reactor L, into DC power and outputs the DC power. Although the commercial AC power source 405 is shown as a single-phase AC power source in the drawing, it may be a three-phase AC power source. An internal structure of the converter 410 also changes depending on a type of the commercial AC power source 405.

Meanwhile, the converter 410 may be configured with a diode or the like without a switching element, and may perform a rectifying operation without a separate switching operation.

For example, in the case of a single-phase AC power source, four diodes may be used in the form of a bridge. On the other hand, in the case of a three-phase AC power source, six diodes may be used in the form of a bridge.

On the other hand, the converter 410, for example, may be a half-bridge type converter in which two switching elements and four diodes are connected. In the case of a three-phase AC power source, six switching elements and six diodes may be used.

When the converter 410 includes a switching element, the converter 410 may perform a boosting operation, a power factor correction, and a DC power conversion by a switching operation of the switching element.

The smoothing capacitor C smooths input power and stores it. In the drawing, one element is illustrated as the smoothing capacitor C, but a plurality of elements may alternatively be provided to ensure element stability.

The smoothing capacitor C is illustrated as being connected to an output end of the converter 410, but the present invention is not limited to this. Alternatively, AC power may be input directly to the smoothing converter 410. For example, DC power from a solar cell may be input to the smoothing capacitor C directly or after DC/DC conversion. Hereinafter, the portions illustrated in the drawing will be mainly described.

On the other hand, both ends of the smoothing capacitor C may be referred to as a DC-link or a DC-link end since DC power is stored.

The DC-link voltage detection unit B may detect DC-link voltages Vdc which are both ends of the smoothing capacitor C. To this end, the DC-link voltage detection unit B may include a resistor element, an amplifier, and the like. The detected DC-link voltage Vdc may be input to the inverter control unit 430 as a pulse type discrete signal.

The inverter unit 420 may include a plurality of inverter switching elements, and convert smoothed DC power Vdc into three-phase AC power va, vb, vc having a predetermined frequency by a switching-on/off operation of the switching elements so as to output the three-phase AC power va, vb, vc to a three-phase synchronous motor 630.

The inverter unit 420 is provided with upper-arm switching elements Sa, Sb and Sc and lower-arm switching elements S'a, S'b and S'c which are connected in series as pairs, respectively, and thus totally three pairs of upper and lower-arm switching elements Sa & S'a, Sb & S'b, and Sc & S'c are connected in parallel. Diodes are connected in anti-parallel to the switching elements Sa, S'a, Sb, S'b, Sc, S'c, respectively.

The switching elements in the inverter unit 420 are switched on and off based on an inverter switching control signal Sic from the inverter control unit 430. Accordingly, the three-phase AC power having the predetermined frequency is output to the three-phase synchronous motor 630.

The inverter control unit 430 may control the switching operation of the inverter unit 420 in a sensorless manner. For this purpose, the inverter control unit 430 may receive an output current idc detected by the output current detection unit E.

The inverter control unit 430 outputs the inverter switching control signal Sic to the inverter unit 420 in order to control the switching operation of the inverter unit 420. The inverter switching control signal Sic is a pulse width modulation (PWM) type switching control signal, and is generated and output based on the output current idc detected by the output current detection unit E. A detailed operation of the output of the inverter switching control signal Sic in the inverter control unit 430 will be described later with reference to FIG. 6.

The output current detection unit E may detect the output current idc flowing to the three-phase motor 630.

The output current detection unit E may be arranged between the DC-link capacitor C and the inverter unit 420 to detect the output current idc flowing to the motor.

In particular, the output current detection unit E may include one shunt resistor element Rs.

The output current detection unit E may use the single shunt resistor element Rs to detect a phase current as the output current idc flowing to the motor 630 in a time division manner when the lower-arm switching element of the inverter unit 420 is turned on.

Phase current detectors S1, S2, and S3 may be connected to the lower-arm switches of respective phases, to detect a phase current flowing to at least one of the plurality of switches.

The detected output current idc which is a pulse type discrete signal may be applied to the inverter control unit 430 and the inverter switching control signal Sic is generated based on the detected output current idc. Hereinafter, description will be given under assumption that the detected output current idc is three-phase output currents ia, ib, ic.

On the other hand, the three-phase motor 630 has a stator and a rotor, and each phase AC power of a predetermined frequency is applied to a coil of the stator of each phase (a, b, c phases), thereby rotating the rotor.

The motor 630 may include a brushless DC (BLDC) motor.

For example, the motor 630 may include a Surface Mounted Permanent Magnet Synchronous Motor (SMPMSM), an Interior Permanent Magnet Synchronous Motor (IPMSM), and a Synchronous Reluctance Motor (Synrm), and the like. Among others, the SMPMSM and the IPMSM are Permanent Magnet Synchronous Motors (PMSMs) employing a permanent magnet, and the Synrm does not use a permanent magnet.

Figure 6:
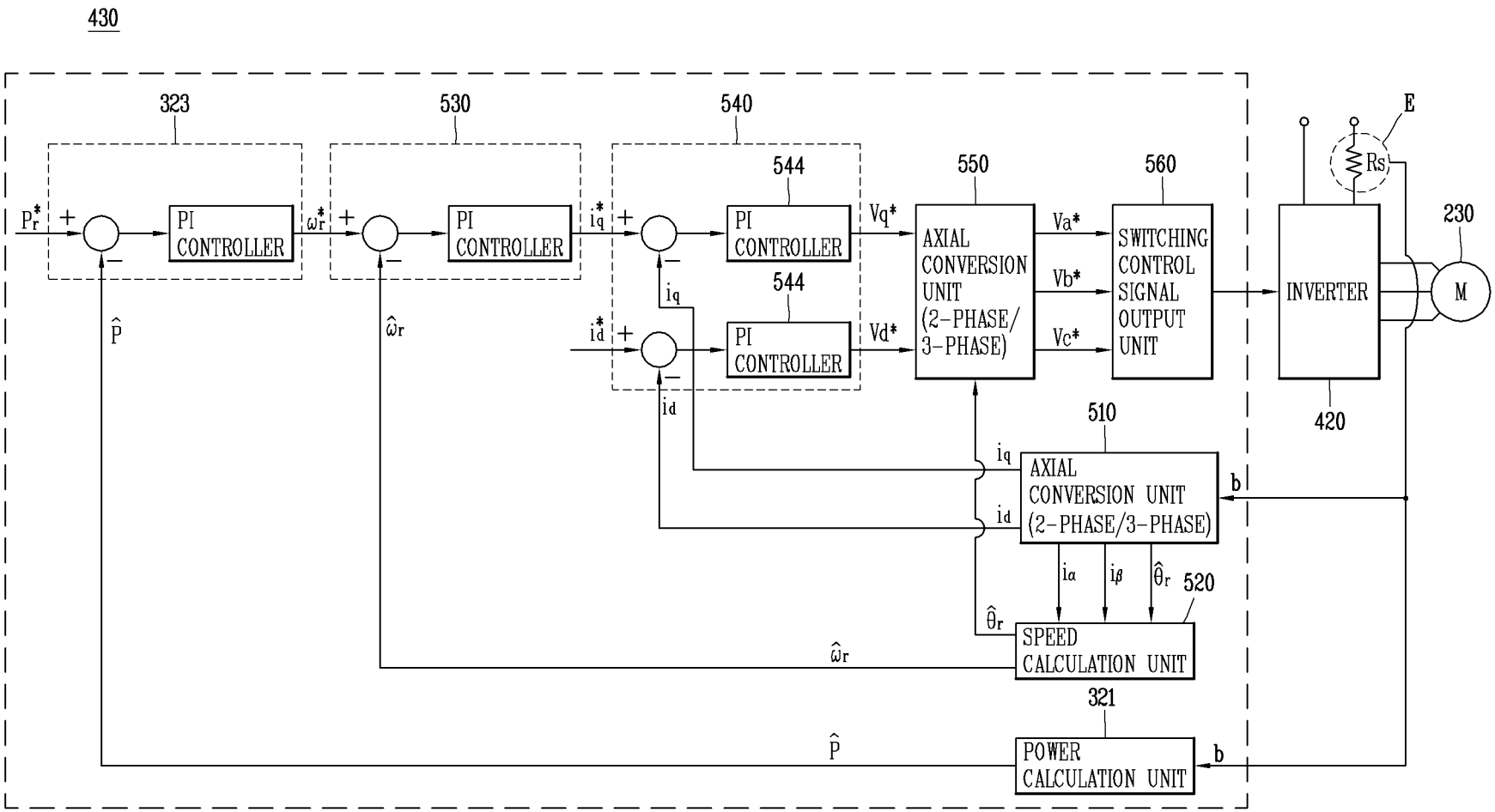
FIG. 6 is an internal block diagram of an inverter control unit of FIG. 5.

FIG. 6 is an internal block diagram of the inverter control unit of FIG. 5.

Referring to FIG. 6, the inverter control unit 430 may include an axial conversion unit 510, a speed calculation unit 520, a power calculation unit 321, a speed command generation unit 323, a current command generation unit 530, a voltage command generation unit 540, an axial conversion unit 550, and a switching control signal output unit 560.

The axial conversion unit 510 may extract the phase currents ia, ib and ic, respectively, from the output current idc detected by the output current detection unit E, and convert the extracted phase currents ia, ib, ic into two-phase currents iα, iβ of a stationary coordinate system.

On the other hand, the axial conversion unit 510 may convert the two-phase currents iα, iβ of the stationary coordinate system into two-phase currents id, iq of a rotating coordinate system.

The speed calculation unit 520 may estimate a position_ based on the output current idc detected by the output current detection unit E and calculate a speed_by differentiating the estimated position.

The power calculation unit 321 may calculate power or a load of the motor 630 based on the output current idc detected by the output current detection unit E.

The speed command generation unit 323 generates a speed command value ω*r based on power P calculated by the power calculation unit 321 and a power command value P*r. For example, the speed command generation unit 323 may perform a PI control in a PI controller 325 based on a difference between the calculated power P and the power command value P*r, and generate the speed command value ω*r.

On the other hand, the current command generation unit 530 generates a current command value i*q based on a computation speed_and the speed command value ω*r. For example, the current command generation unit 530 may perform a PI control in a PI controller 535 based on a difference between the computation speed_and the speed command value ω*r, and generate the current command value i*q. In the drawing, a q-axis current command value i*q is illustrated as the current command value, but it is also possible to generate a d-axis current command value i*d as well, unlike the drawing. On the other hand, the d-axis current command value i*d may be set to zero.

On the other hand, the current command generation unit 530 may further include a limiter (not shown) for limiting a level of the current command value i*q so that the current command value i*q does not exceed an allowable range.

Next, the voltage command generation unit 540 generates d-axis and q-axis voltage command values v*d, v*q based on d-axis and q-axis currents id and iq that are axially converted to a two-phase rotating coordinate system in the axial conversion unit and the current command values i*d, i*q from the current command generation unit 530 and the like. For example, the voltage command generation unit 540 may perform a PI control in a PI controller 544 based on a difference between the q-axis current iq and the q-axis current command value i*q, and generate the q-axis voltage command value v*q. The voltage command generation unit 540 may perform a PI control in a PI controller 548 based on a difference between the d-axis current id and the d-axis current command value i*d, and generate the d-axis voltage command value v*d. The voltage command generation unit 540 may further include a limiter (not shown) for limiting a level of the d-axis and q-axis voltage command values v*d, v*q, so that the d-axis and q-axis voltage command values v*d, v*q do not exceed an allowable range.

On the other hand, the generated d-axis and q-axis voltage command values v*d, v*q are input to the axial conversion unit 550.

The axial conversion unit 550 performs an axial conversion by receiving the position calculated by the speed calculation unit 520 and the d-axis and q-axis voltage command values v*d, v*q.

First, the axial conversion unit 550 performs conversion from a two-phase rotating coordinate system to a two-phase stationary coordinate system. At this time, the position calculated by the speed calculation unit 520 may be used.

Then, the axial conversion unit 550 performs conversion from the two-phase stationary coordinate system to a three-phase stationary coordinate system. Through this conversion, the axial conversion unit 1050 outputs three-phase output voltage command values v*a, v*b, v*c.

The switching control signal output unit 560 generates an inverter switching control signal Sic according to the pulse width modulation (PWM) method based on the three-phase output voltage command values v*a, v*b and v*c, and outputs the generated inverter switching control signal Sic.

The output inverter switching control signal Sic may be converted into a gate driving signal in a gate driving unit (not shown) and input to a gate of each switching element in the inverter unit 420. As a result, each of the switching elements Sa, S'a, Sb, S'b, Sc, and S'c in the inverter unit 420 performs the switching operation.

Hereinafter, description will be given of a laundry treating apparatus capable of determining whether or not clogging of a drain pump occurs and solving the clogging.

Figure 7A:
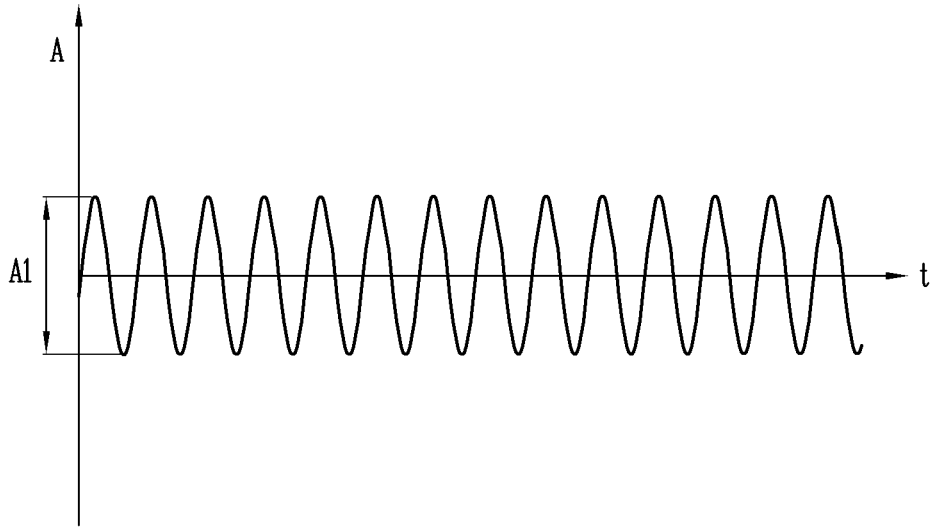
FIGS. 7A and 7B are graphs showing a phase current and a DC-link current of an inverter unit connected to a motor of a drain pump that operates normally.
Figure 7B:
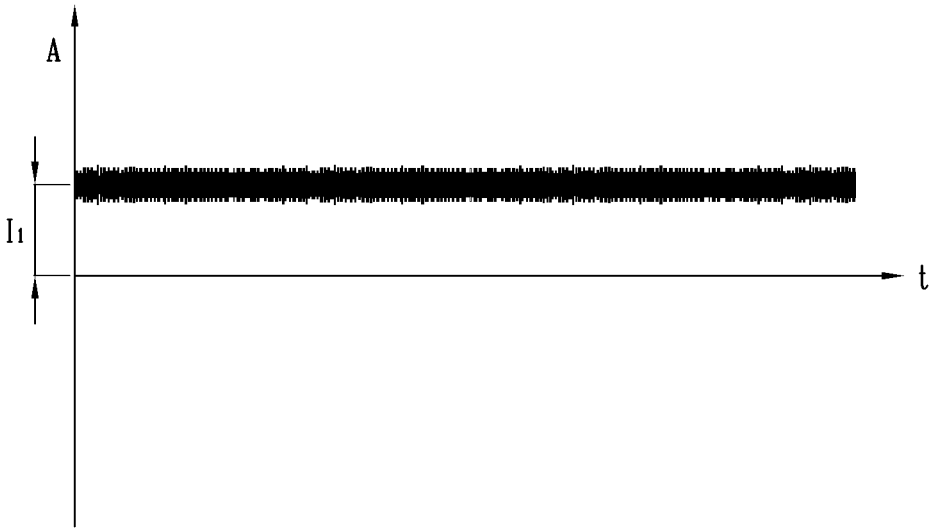

FIGS. 7A and 7B are graphs showing a phase current and a DC-link current of an inverter unit connected to a motor of a drain pump that operates normally.

Figure 8A:
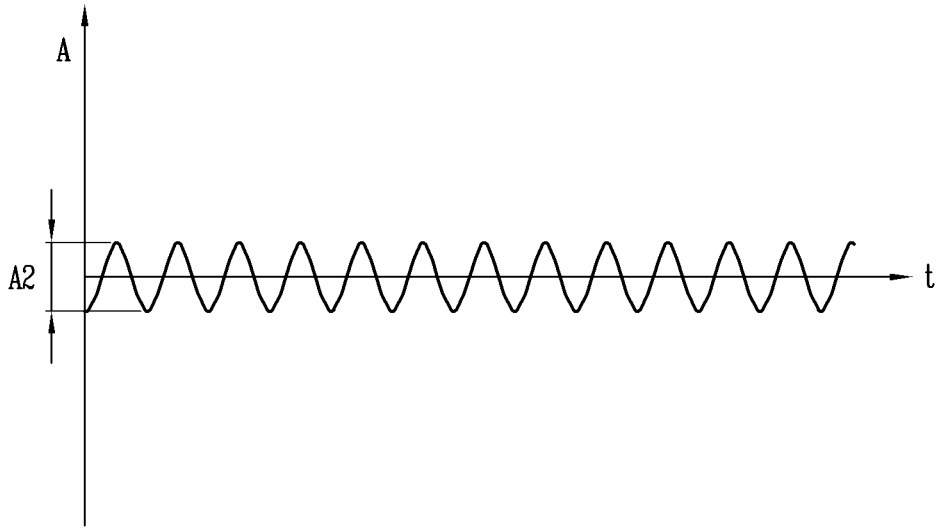
FIGS. 8A and 8B are graphs showing a phase current and a DC-link current of the inverter unit connected to the motor when clogging occurs in the drain pump.
Figure 8B:
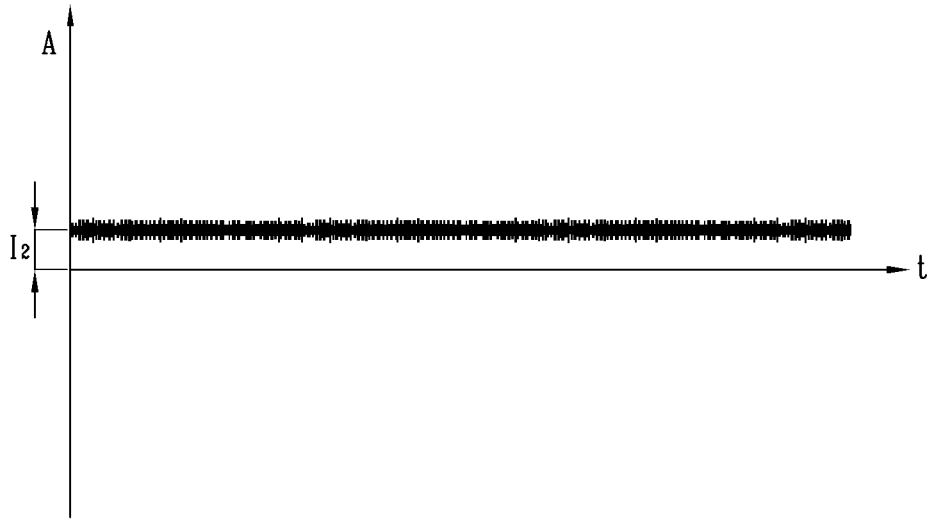

FIGS. 8A and 8B are graphs showing a phase current and a DC-link current of the inverter unit connected to the motor when clogging occurs in the drain pump.

For reference, a phase current refers to a current flowing in each switch of the inverter unit 420, and a DC-link current refers to a current flowing in the DC-link capacitor.

Comparing FIG. 7A with FIG. 8A, it can be seen that a peak-to-peak value of a phase current of the drain pump is a first peak-to-peak value A1 in a normal state and a second peak-to-peak value A2 in a clogged state. That is, if the drain pump is clogged, the peak-to-peak value of the phase current decreases.

In one example, when the drain pump is clogged, the peak-to-peak value of the phase current may decrease down to 50% or less as compared to the peak-to-peak value of the phase current in the normal state.

Similarly, comparing FIG. 7B with FIG. 8B, it can be seen that a magnitude of a DC-link current of the drain pump is a first current value I1 in a normal state and a second current value I2 in a clogged state. That is, if the drain pump is clogged, the magnitude of the DC-link current also decreases.

In one example, the second current value I2 may correspond to 50% of the first current value I1.

Using this phenomenon, the present invention proposes a control method for the laundry treating apparatus 100, capable of determining whether or not the drain pump is clogged.

Figure 9:
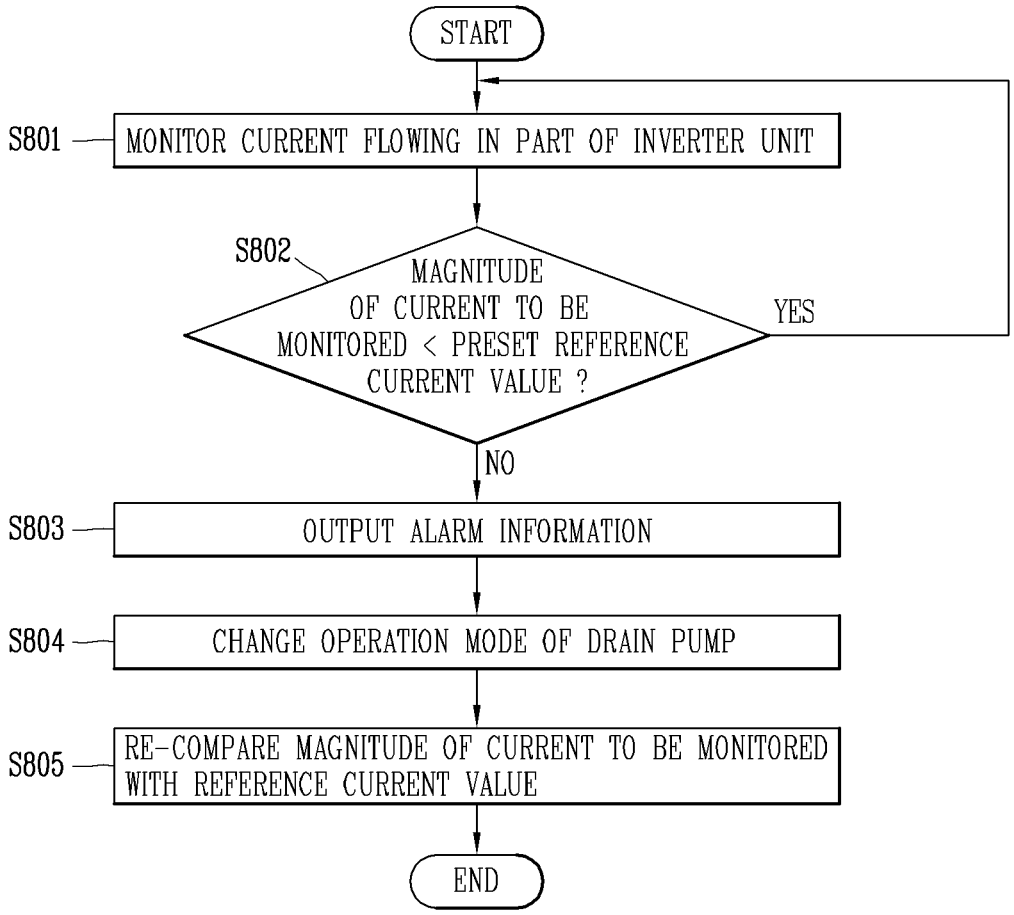
FIG. 9 is a flowchart illustrating a control method for a laundry treating apparatus in accordance with one embodiment of the present invention.

FIG. 9 illustrates one embodiment related to the control method for the laundry treating apparatus 100 according to the present invention.

When the operation of the drain pump is started, the control unit 210 may monitor a current flowing in a part of the inverter unit 420 (S801).

In one embodiment, when the operation of the drain pump is started, the control unit 210 may monitor a DC-link current flowing in the DC-link capacitor of the inverter unit 420. At this time, the control unit 210 may monitor the DC-link current using a shunt resistor.

In another embodiment, the control unit 210 may monitor a phase current flowing in any one of the plurality of switches included in the inverter unit 420. At this time, the control unit 210 may monitor the phase current using the phase current detection units S1, S2, S3 connected to the switches.

The control unit 210 according to the present invention may monitor the current flowing in the part of the inverter unit 420, to determine whether or not at least one of a flow path formed in the drain pump and a flow path connected to the drain pump has been clogged. That is, the control unit 210 may determine whether clogging associated with the drain pump has occurred, based on a DC-link current or a phase current. Criteria for determining the clogging will be described in more detail below.

The control unit 210 may determine whether a magnitude of a current to be monitored is smaller than a preset reference current value (S802).

For example, when a current to be monitored is a DC-link current, the reference current value may correspond to 50% of an average magnitude of the DC-link current when the drain pump operates normally.

In another example, when a current to be monitored is a phase current, the reference current value may correspond to 50% of an average peak-to-peak value of the phase current when the drain pump operates normally.

When the control unit 210 determines that the magnitude of the current to be monitored is smaller than the reference current value, the control unit 210 may control the display 118 to output alarm information (S803).

That is, when the magnitude of the DC-link current is reduced down to the reference current value, the control unit 210 may determine that at least one of a flow path formed in the drain pump and a flow path connected to the drain pump has been clogged.

Specifically, when the DC-link current is maintained at the reference current value or less for more than a predetermined time interval, the control unit 210 may determine that at least one of the flow path formed in the drain pump and the flow path connected to the drain pump has been clogged.

For example, the alarm information may include text information "The drain pump is clogged" and a preset icon image.

Meanwhile, when the alarm information is output, the control unit 210 may control the display 118 to change brightness, a background color, and the like of a screen output on the display 118.

In addition, the control unit 210 may set an operation mode of the drain pump on the basis of the current flowing in the part of the inverter unit 420, and control the inverter unit 420 based on the set operation mode.

Specifically, when it is determined that the magnitude of the current to be monitored is smaller than the reference current value, the control unit 210 may change the operation mode of the drain pump (S804).

For reference, the operation mode of the drain pump is divided into a stop mode, a first operation mode and a second operation mode.

First, when the operation mode of the drain pump is the stop mode, the control unit 210 may stop the motor of the drain pump.

Further, when the operation mode of the drain pump is the first operation mode, the control unit 210 may control the operation of the drain pump by using a power command value related to power consumed in the motor of the drain pump.

That is, when the operation mode of the drain pump is the first operation mode, the control unit 210 may generate a predetermined power command value such that the power consumed by the motor of the drain pump corresponds to a preset power value, and control the motor and the inverter unit of the drain pump using the generated power command value.

In general, the preset power value may be set to be larger than power consumed by the motor of the drain pump when the drain pump circulates washing water or performs an operation of draining washing water remaining in the washing tub. For example, the preset power value may be 25 W.

Accordingly, when the operation mode of the drain pump is changed to the first operation mode, the control unit 210 may increase the DC-link current flowing in the DC-link capacitor to a predetermined current value. When the DC-link current is increased to the predetermined current value, the power consumed by the drain pump may correspond to the preset power value.

That is, when the operation mode of the drain pump is set to the first operation mode, the control unit 210 may increase the power consumed by the motor to the preset power value.

When the operation mode of the drain pump is the second operation mode, the control unit 210 may generate a speed command value related to a rotation speed of the motor of the drain pump, and control the inverter unit 420 based on the generated speed command value. For example, a default speed command value may be 2800 RPM.

That is, when the operation mode of the drain pump is set to the second operation mode, the control unit 210 may variably control a duty ratio of the switches included in the inverter unit 420 so as to set the rotation speed of the motor of the drain pump to a specific speed value.

Referring back to FIG. 9, the control unit 210 may set the operation mode of the drain pump to the first operation mode when it is determined that the magnitude of the current to be monitored is smaller than the reference current value.

That is, when it is determined that the magnitude of the DC-link current of the inverter unit 420 is smaller than the reference current value, the control unit 210 may set the operation mode of the drain pump to the first operation mode so that the DC-link current can increase to a predetermined value.

In other words, when it is determined that the magnitude of the DC-link current of the inverter unit 420 is smaller than the reference current value, the control unit 210 may set the operation mode of the drain pump to the first operation mode, so that power consumed by the motor can increase to the preset power value.

When the drain pump terminates the first operation mode, the control unit 210 may compare the magnitude of the current to be monitored with the reference current value again (S805).

For example, when the drain pump terminates the first operation mode, the control unit 210 may compare the magnitude of the DC-link current of the inverter unit 420 with the reference current value again.

In another example, when the drain pump terminates the first operation mode, the control unit 210 may compare the magnitude of the phase current of the inverter unit 420 with the reference current value again.

In one embodiment, the control unit 210 may set the operation mode of the drain pump to the second operation mode when the magnitude of the DC-link current increases to the reference current value or more after the first operation mode of the drain pump is terminated.

That is, when the magnitude of the DC-link current increases to the reference current value or more after the first operation mode of the drain pump is terminated, the control unit 210 may determine that the clogging of the drain pump has been solved and set the operation mode of the drain pump to the second operation mode which is a normal operation mode.

In another embodiment, when the peak-to-peak value of the phase current is increased to the reference current value (peak-to-peak value) or more after the first operation mode of the drain pump is terminated, the control unit 210 may set the operation mode of the drain pump to the second operation mode.

On the other hand, after the first operation mode of the drain pump is terminated, before the magnitude of the current to be monitored is compared with the reference current value again, the control unit 210 may control the inverter unit 420 to turn off all the switches included in the inverter unit 420 for a predetermined time interval.

That is, the control unit 210 may perform the first operation mode for a predetermined time to solve the clogging of the drain pump, and then set the drain pump to the stop mode for a predetermined time interval without comparing the magnitude of the current to be monitored with the reference current value immediately after the termination of the first operation mode.

Meanwhile, the control unit 210 may synchronize and desynchronize the rotation of the main motor which supplies a rotational force to the washing tub with the rotation of the motor 630 of the drain pump. That is, the control unit 210 may synchronize the main motor and the motor 630 in one section and may desynchronize the main motor and the motor 630 in other sections except for the one section.

In one embodiment, the control unit 210 may determine whether a magnitude of a current to be monitored is reduced below the reference current value in the state where the motor 630 and the main motor are synchronized with each other. That is, the control unit 210 may determine whether the magnitude of the detected DC-link current is reduced below the reference current value while the motor 630 and the main motor are synchronized with each other.

When the magnitude of the detected DC-link current is reduced below the reference current value while the motor 630 and the main motor are synchronized with each other, the control unit 210 may change the operation mode of the drain pump after the synchronized state between the motor 630 and the main motor is released.

Hereinafter, another embodiment related to the control method for the laundry treating apparatus 100 according to the present invention will be described, with reference to FIG. 10.

First, the control unit 210 may start a selected operation mode of the laundry treating apparatus (S901). When the operation of the drain pump is included in a process of the selected operation mode, the control unit 210 may operate the drain pump in the second operation mode at a predetermined time point.

That is, the control unit 210 may operate the drain pump in the second operation mode in order to drain residual washing water of the washing tub or circulate the washing water of the washing tub. Therefore, before finding clogging of the drain pump, the control unit 210 may typically generate a speed command value to control the rotation speed of the motor of the drain pump, and control the duty ratio of each switch of the inverter unit 420 based on the generated speed command value.

When the operation mode of the laundry treating apparatus is started, the control unit 210 may monitor a current flowing in a part of the inverter unit 420 (S902). As described above, the current to be monitored may be the DC-link current or the phase current.

In addition, the control unit 210 may determine whether a water level of the washing tub exceeds a preset reference water level value and whether a magnitude of the current to be monitored is reduced below a reference current value (S903).

For reference, the washing tub may be provided with a water level sensor for sensing information related to the water level formed by the washing water present in the washing tub. The control unit 210 may detect the information related to the water level of the washing tub based on an output of the water level sensor.

In one embodiment, when a frequency of the water level sensor is a preset reference frequency value or less and a detected DC-link current falls below the reference current value, the control unit 210 may determine that at least one of the flow path formed in the drain pump and the flow path connected to the drain pump has been clogged.

In another embodiment, when a frequency of the water level sensor is a preset reference frequency value or less and a detected phase current falls below the reference current value, the control unit 210 may determine that at least one of the flow path formed in the drain pump and the flow path connected to the drain pump have been clogged.

When the residual washing water of the washing tub is relatively small in amount, the current flowing in the inverter unit 420, which applies power to the drain pump, may be reduced due to a decrease of a load. Therefore, the control unit 210 may determine whether the drain pump has been clogged only when the water level is a predetermined height or higher. This may result in preventing a mistaken determination as the drain pump being clogged.

The control unit 210 may set the operation mode of the drain pump to the first operation mode when the water level of the washing tub exceeds the preset reference water level value and the current to be monitored is lower than the reference current value (S904).

When the first operation mode of the drain pump is terminated, the control unit 210 may turn off all the switches included in the inverter unit 420 for a predetermined time interval (S905).

Thereafter, the control unit 210 may change the operation mode of the drain pump to the second operation mode (S906).

On the other hand, when the first operation mode of the drain pump is terminated, the control unit 210 may change the operation mode of the drain pump to a specific operation mode, in which the drain pump operated before it is determined that the drain pump is in the clogged state.

As described above, when the drain pump normally operates, it generally operates in the second operation mode. Therefore, in the description of the present invention, the second operation mode is set when the first operation mode of the drain pump is terminated.

In addition, when the operation mode of the drain pump is changed to the second operation mode, the control unit 210 may re-compare the magnitude of the current to be monitored with the reference current value (S907).

For reference, the control unit 210 may change the reference current value in the re-comparison step S907. That is, the control unit 210 may detect the number of times the first operation mode of the drain pump is performed for a predetermined time interval and may change the reference current value based on the detected number of times.

On the other hand, after the operation mode is changed to the second operation mode, the control unit 210 may re-detect the information related to the water level of the washing tub and determine whether to perform the re-comparison step S907 based on the re-detected water level.

Hereinafter, another embodiment related to the control method for the laundry treating apparatus 100 according to the present invention will be described, with reference to FIG. 11.

Figure 10:
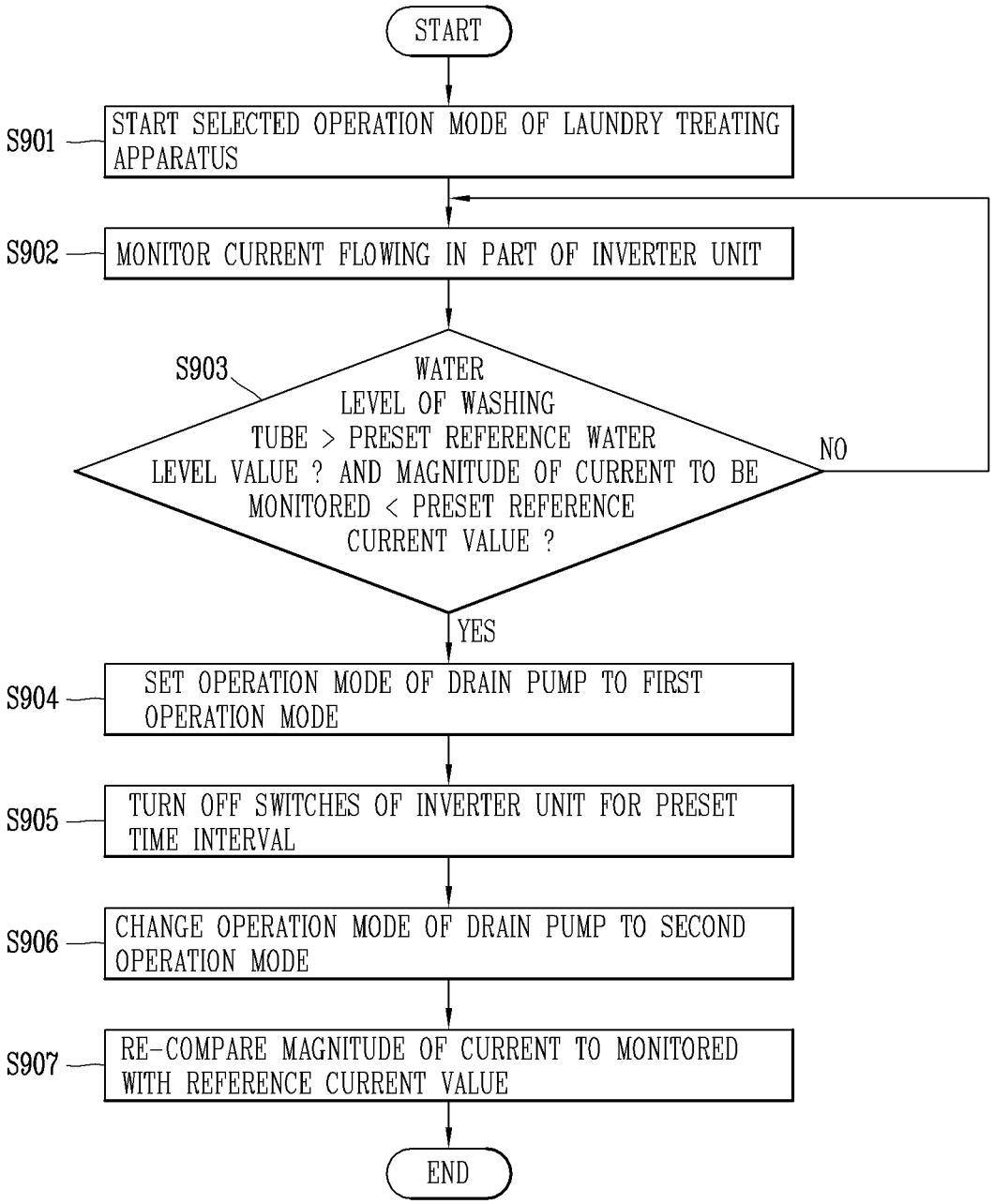
FIG. 10 is a flowchart illustrating a control method for a laundry treating apparatus in accordance with another embodiment of the present invention.

The process is started from a re-comparison step (S1001) which corresponds to the re-comparison step S805 of FIG. 9 or the re-comparison step S907 of FIG. 10. In the control method illustrated in FIG. 11, it is assumed that the previous steps of the re-comparison step S805 described in FIG. 9 and the previous steps of the re-comparison step S907 described in FIG. 10 have been performed.

Figure 11:
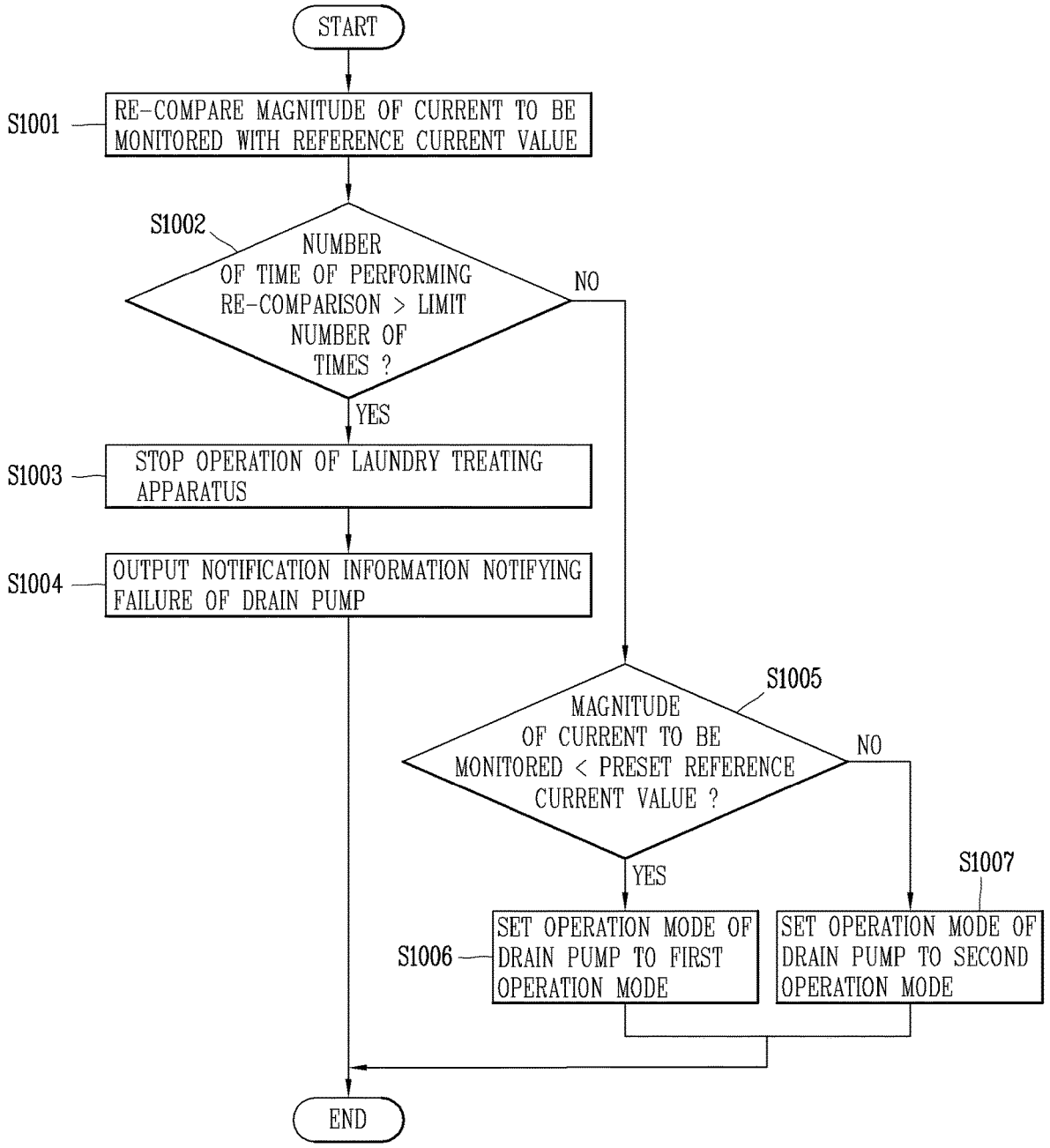
FIG. 11 is a flowchart illustrating a control method for a laundry handling apparatus in accordance with another embodiment of the present invention.

Referring to FIG. 11, the control unit 210 may determine whether the number of times the re-comparison has been performed exceeds a preset limit number of times (S1002).

Further, the control unit 210 may determine whether the number of times the first operation mode of the drain pump has been performed exceeds the preset limit number of times after the operation of the laundry treating apparatus is started.

As described above, when it is determined that the drain pump has been clogged, the control unit 210 may set the operation mode of the drain pump to the first operation mode to increase power consumed by the motor of the drain pump so as to eliminate the clogging of the drain pump.

However, when the first operation mode is repeatedly performed, there is a problem that a failure of the motor of the drain pump or the inverter unit 420 may be caused.

In order to solve such a problem, the control unit 210 according to the present invention may limit the number of times that the re-comparison step S1001 or the first operation mode is repeatedly performed for a predetermined time interval.

The control unit 210 may terminate the operation of the laundry treating apparatus when the number of times of performing the re-comparison step S1001 exceeds a limit number of times.

In addition, the control unit 210 may control the display 118 to output notification information for notifying a failure of the drain pump.

At this time, the notification information output on the display 118 may be set to be different from the alarm information S803 indicating the clogging of the drain pump.

For example, the notification information may include at least one of text "drain pump failure" and text "stop the operation of the laundry treating apparatus".

On the other hand, when the number of times of performing the re-comparison step S1001 is less than the limit number of times, the control unit 210 may compare the magnitude of the current to be monitored with the reference current value (S1005), and set the operation mode of the drain pump to the first operation mode (S1006) or the second operation mode (S1007) based on the comparison result. Since the steps S1005 to S1007 have been described with reference to FIGS. 9 and 10, detailed description thereof will be omitted.

Figure 12:
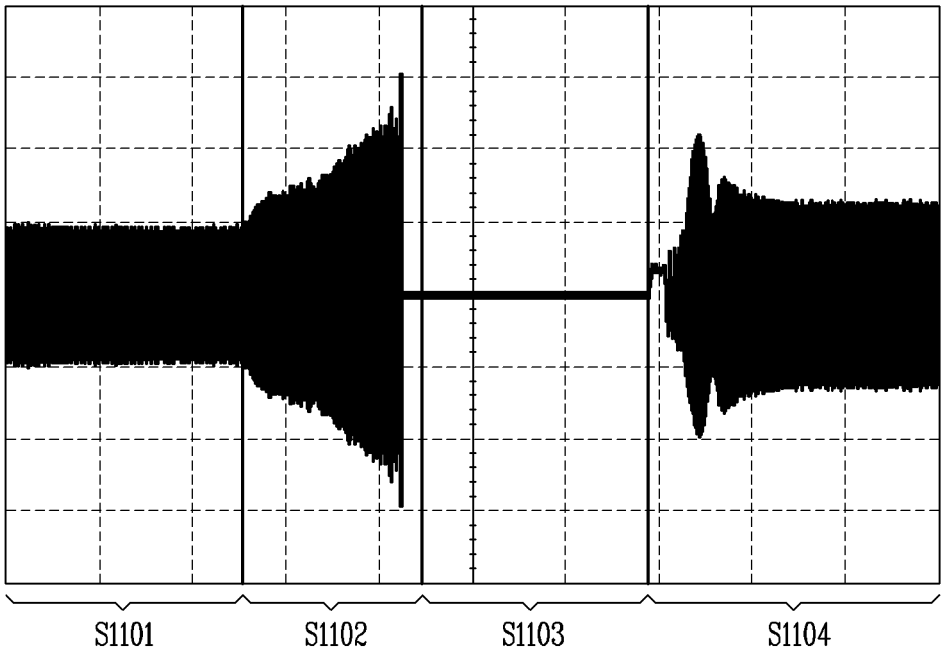
FIG. 12 is a graph showing changes in a phase current of an inverter unit when the control method for a laundry treating apparatus according to the present invention is performed.

Referring to FIG. 12, there is shown a graph showing a phase current that changes depending on a state of the drain pump.

The graph shown in FIG. 12 shows a first section S1101 in which the drain pump is clogged, a second section S1102 in which the drain pump operates in the first operation mode, a third section S1103 in which the drain pump operates in the stop mode, and a fourth section (S1104) in which the drain pump operates in the second operation mode.

Comparing a phase current of the first section S1101 with a phase current of the fourth section S1104, it can be confirmed that the magnitude of the phase current decreases when the clogging occurs.

When it is determined that the drain pump has been clogged in the first section S1101, the control unit 210 may set the operation mode of the drain pump to the first operation mode, so as to increase power consumed in the drain pump in the second section S1102.

That is, in the second section S1102, a peak-to-peak value of the phase current may increase due to a power command value set according to the first operation mode.

In the third section S1103, the control unit 210 turns off all the switches, and thus the phase current becomes zero.

The laundry treating apparatus according to the present invention can determine whether the flow path in the drain pump or the flow path connected to the drain pump has been clogged even without additionally using a separate sensor, thereby enhancing user convenience.

Also, the laundry treating apparatus according to the present invention can control the BLDC motor based on the power command value corresponding to a predetermined power value when it is determined that the clogging of the drain pump has occurred, thereby eliminating the clogging of the drain pump.

Therefore, according to the control method for the laundry treating apparatus according to the present invention, a lifespan of the drain pump or the flow path connected to the drain pump can increase and a failure of the laundry treating apparatus can be prevented.

Further, the laundry treating apparatus according to the present invention can notify the user of the clogging of the drain pump, thereby inducing the user to recognize the failure of the drain pump.

What is claimed is:

1. A laundry treating apparatus, comprising:

a drain pump having a motor;

an inverter configured to transfer power to the motor;

a direct current (DC)-link capacitor connected to the inverter; and a controller configured to:

control the inverter to operate the drain pump, based on a current in a part of the inverter being lower than a reference current, set an operation mode of the drain pump to a first operation mode in which the drain pump is controlled by a power command value related to power consumed by the motor, control the inverter based on the first operation mode, based on the operation mode of the drain pump being set to the first operation mode, generate a first power command value that is predetermined to control the power consumed by the motor to a preset power value, and increase a direct current (DC)-link current flowing in the DC-link capacitor to a predetermined current value to thereby bring the power consumed by the motor to the preset power value.

2. The apparatus of claim 1, wherein the DC-link capacitor is configured to store power, wherein the inverter comprises a plurality of switches to perform a switching operation, and wherein the apparatus further comprises a shunt resistor disposed between the DC-link capacitor and the plurality of switches.

3. The apparatus of claim 2, wherein the controller is configured to:

detect the DC-link current flowing in the DC-link capacitor using the shunt resistor, and set the operation mode of the drain pump based on the detected DC-link current.

4. The apparatus of claim 3, wherein the controller is configured to set the operation mode of the drain pump to the first operation mode based on a magnitude of the detected DC-link current being decreased to a preset reference current value or less.

5. The apparatus of claim 4, wherein the controller is configured to increase the power consumed by the motor to a predetermined power value based on the operation mode of the drain pump being set to the first operation mode.

6. The apparatus of claim 4, wherein the controller is configured to compare the magnitude of the DC-link current with the reference current value based on the first operation mode being terminated.

7. The apparatus of claim 6, wherein the controller is configured to set the operation mode of the drain pump to a second operation mode based on the magnitude of the DC-link current being increased to the reference current value or more after the first operation mode is terminated.

8. The apparatus of claim 7, wherein the controller is configured to control the inverter to set a rotation speed of the motor to a predetermined speed value based on the operation mode of the drain pump being set to the second operation mode.

9. The apparatus of claim 6, wherein the controller is configured to control the inverter to turn off all of the plurality of switches for a predetermined time interval before comparing the magnitude of the DC-link current with the reference current value after the first operation mode is terminated.

10. The apparatus of claim 4, wherein the controller is configured to stop operating the drain pump based on the first operation mode having been performed more than a preset limit number of times.

11. The apparatus of claim 3, wherein the controller is configured to determine that at least one of a flow path formed in the drain pump or a flow path connected to the drain pump has been clogged based on a magnitude of the detected DC-link current being decreased to a predetermined reference current value or less.

12. The apparatus of claim 11, wherein the controller is configured to determine that the at least one of the flow path formed in the drain pump or the flow path connected to the drain pump has been clogged based on the detected DC-link current being maintained at the reference current value or less for more than a predetermined time interval.

13. The apparatus of claim 11, further comprising an output unit to output information related to operation of the laundry treating apparatus, wherein the controller is configured to control the output unit to output alarm information based on determining that the at least one of the flow path formed in the drain pump or the flow path connected to the drain pump has been clogged.

14. The apparatus of claim 11, further comprising:

a washing tub configured to accommodate laundry and washing water therein; and a water level sensor configured to detect information related to a water level of the washing water accommodated in the washing tub, wherein the controller is configured to set the operation mode of the drain pump using the water level sensor.

15. The apparatus of claim 14, wherein the controller is configured to determine that the at least one of the flow path formed in the drain pump or the flow path connected to the drain pump has been clogged based on a frequency of the water level sensor being less than or equal to a preset reference frequency value and the detected DC-link current being lowered to the reference current value or less.

16. The apparatus of claim 14, wherein the controller is configured to determine whether the magnitude of the detected DC-link current is decreased to the reference current value or less while the motor and the washing tub are synchronized.

17. The apparatus of claim 16, wherein the controller is configured to set the operation mode of the drain pump after the synchronization between the motor and the washing tub is released based on the magnitude of the detected DC-link current being decreased to the reference current value or less while the motor and the washing tub are synchronized.

18. The apparatus of claim 2, wherein the inverter further comprises:

a current sensor configured to detect a phase current flowing in at least one of the plurality of switches, and wherein the controller is configured to detect a magnitude of the phase current using the current sensor.

19. The apparatus of claim 18, wherein the controller is configured to set the operation mode of the drain pump based on the magnitude of the phase current.

20. The apparatus of claim 2, further comprising a converter configured to convert alternating current (AC) to the DC-link current, the DC-link capacitor having:

a first end that is connected to an end of the converter and to ends of the plurality of switches; and a second end that is connected to another end of the converter and to an end of the shunt resistor.

* * * * *